United States Patent [19]

Patel

[11] 4,426,965

[45] Jan. 24, 1984

[54] UNITIZED OIL COOLER AND FILTER ASSEMBLY

[75] Inventor: Harshad H. Patel, Columbus, Ind.

[73] Assignee: Cummins Engine Company, Inc., Columbus, Ind.

[21] Appl. No.: 347,969

[22] Filed: Feb. 11, 1982

[51] Int. Cl.[3] ..... F02M 1/00

[52] U.S. Cl. ..... 123/196 AB; 123/196 R; 165/51; 165/82; 210/184; 184/104 B

[58] Field of Search ..... 123/196 AB, 196 R; 165/82, 51; 210/181, 184, 186; 184/104 B

[56] References Cited

U.S. PATENT DOCUMENTS

| | | | |
|---|---|---|---|
| 1,831,337 | 11/1931 | Bennett | 165/119 R |
| 2,240,537 | 5/1941 | Young | 165/151 X |
| 2,512,748 | 6/1950 | Lucke | 165/175 X |
| 2,978,226 | 4/1961 | White | 165/82 |
| 3,353,590 | 11/1967 | Holman | 165/175 X |
| 3,561,417 | 2/1971 | Downey | 123/196 A |
| 3,830,289 | 8/1974 | Olson | 165/119 |
| 4,207,944 | 6/1980 | Holtz et al. | 165/82 |

FOREIGN PATENT DOCUMENTS

| | | | |
|---|---|---|---|
| 2001793 | 7/1971 | Fed. Rep. of Germany | 165/119 |
| 2067737 | 7/1981 | United Kingdom | 165/119 |

*Primary Examiner*—Charles J. Myhre
*Assistant Examiner*—E. Rollins Cross
*Attorney, Agent, or Firm*—Sixbey, Friedman & Leedom

[57] ABSTRACT

A cooler and filter assembly (2) is disclosed including a cooler housing (4) containing an elongated internal cavity (14) opening into generally planar end faces (16 and 18) of the cooler housing (4) and further including a support structure (6) for mounting the cooler housing (4) on an internal combustion engine and for providing internal supply and return passages (104, 106, 108 and 110) for both engine coolant and lubrication oil through only one of the planar end faces (16) of the cooler housing (4). A thermostatically controlled valve (118) and an oil pressure responsive valve means (80) control the flow of oil through the cooler and filter assembly (2) to insure efficient and safe operation of the assembly (2). A heat exchange means (24) includes a fixed plate-like member (30) for mounting one end of each of a plurality of elongated tubes (26) and also contains oil supply and return apertures (54 and 56) which allow for simplification of the arrangement of flow passages within the assembly (2).

21 Claims, 20 Drawing Figures

UNITIZED OIL COOLER AND FILTER ASSEMBLY

DESCRIPTION

1. Technical Field

This invention relates to an oil cooler and filter assembly adapted to be mounted directly on the block of an internal combustion engine by means of a cooler support having internal fluid flow passages directly communicating with oil and coolant flow ports opening through the side of the engine block.

2. Background Art

Numerous attempts have been made to simplify the design of oil coolers for internal combustion engines. One particularly important objective in prior designs has been to minimize the number of external conduits leading to and from the cooler assembly. Each such conduit is not only a source of potential leaks but also is subject to accidental damage during installation or use of the engine which could lead to catastrophic failure should either the lubrication fluid or engine coolant be lost. External conduits can also impart an extremely cluttered appearance to an engine and, thus, tend to decrease its marketability.

Attempts to reduce the number of external conduits has generally centered on the design of a mounting bracket for an oil cooler assembly wherein lubrication oil supply and return passages contained within the mounting bracket are designed for communication with supply and return ports formed directly on the side of an engine block. U.S. Pat. Nos. 3,561,417 to Downey and 3,353,590 to Holman disclose examples of oil cooler assemblies in which the mounting bracket for the oil cooler assembly contains internal supply and return passages for the engine lubricating oil. However, neither of these disclosures suggests a means of providing coolant supply and return passages within the same mounting bracket.

Further complicating the difficulty of internalizing the fluid supply and return passages is the necessity of providing proper flow control functions in order to obtain optimum operation of the oil cooler and associated lubrication filter. For example, it is known to be desirable to avoid lubrication oil cooling under certain engine operating conditions. This is normally accomplished by a flow diverting valve which responds to lubrication oil temperature. The patent to Holman (U.S. Pat. No. 3,353,590) discloses a valve of this type mounted within the cooler housing. It is also desirable to be able to bypass flow around an oil filter whenever the filter becomes clogged or plugged to assure, thereby, that oil will continue to circulate to the vital components of the engine. No single prior art cooler assembly design has shown how to internalize the supply and return passages while also providing internally mounted bypass and temperature sensing valves.

Economy of manufacture is, of course, a primary objective of any practical oil cooler/filter assembly design. However, this requirement is often at odds with other objectives such as durability and reliability. In this later regard, differential thermal expansion of those components which form the heat exchanger portion of the cooler assembly can lead to premature failure if the cooler assembly is improperly designed. Attempts to accommodate thermally induced differential changes in component sizes within a heat exchanger have been disclosed in U.S. Pat. Nos. 2,240,537 to Young; 2,512,748 to Lucke and 4,207,944 to Holtz et al. In particular, the patent to Lucke discloses a shell within which is mounted a plurality of tubes each of which is connected at one end to an anchored sheet and at its other end to a floating type sheet sealingly engaged at its perimeter to the heat exchanger housing by means of a rubber ring to compensate for relative expansion of the tubes and shell. While useful for the purposes disclosed, the designs disclosed by these patents fail to suggest how the coolant inlet and outlet passages can be arranged to begin and end adjacent the same end portion of the assembly in a manner which would assist in simplifying the mounting and sealing structure of the oil cooler assembly. In this regard, U.S. Pat. No. 1,831,337 to Bennett discloses a heat exchanger including a casing or shell and a pair of tube nests placed longitudinally within a chamber formed in the shell wherein the tube nests are supported by a tube sheet or plate rigidly connected with the shell. A header containing a transfer chamber is connected to the ends of the tubes remote from the plate to effect transfer of fluid received through the tubes of one nest for return through the tubes of the second nest. The header is said to be "floating" but does not suggest specifically that the header may move longitudinally in response to thermally induced changes in the length of the tubes relative to the shell and does not suggest sealing the space between the floating head and shell to confine heat exchange fluid flow in a manner to maximize heat exchange fluid flow in a manner to maximize heat exchange efficiency.

In summary, no oil cooler and filter assembly design has been known heretofore which provides a compact, simplified assembly which minimizes the number of external fluid flow conduits while at the same time provides full flow control capabilities and accommodates thermally induced differential expansion of components.

DISCLOSURE OF THE INVENTION

It is a primary object of this invention to overcome the deficiencies of the prior art as discussed above by providing an oil cooler and filter assembly including a support structure for mounting a cooler housing on the engine and for providing isolated fluid flow passages between the engine and the cooler housing. This primary object is obtained in part by the provision of a flat plate-like member sandwiched between the cooler housing and support structure for supporting the ends of a plurality of heat exchanger tubes wherein the plate-like member contains at least one oil inlet aperture through which oil flows from the support structure into the cooler housing and at least one oil return aperture through which oil flows from the cooler housing into the support structure.

It is another object of the subject invention to provide a compact, relatively light weight, oil cooler and filter assembly in which the flow passages for supply and return of both lubricating oil and engine coolant are provided through a single end support structure for the cooler housing. Within the cooler housing are mounted a plurality of heat exchanger tubes each of which is fixed at one end by a plate-like member and is free to move axially at the other end relative to the cooler housing.

Still another object of the subject invention is to provide a compact oil cooler and filter assembly containing a thermostatically operated oil flow control valve mounted within the support structure for diverting oil flow around the heat exchanger element whenever the oil temperature is below a predetermined level combined with a bypass valve mounted at the end of the oil cooler housing remote from the support structure to cause lubrication oil flow to be bypassed around an oil filter whenever the pressure differential across the filter reaches a predetermined level. The bypass valve is also designed to generate a warning signal whenever the predetermined pressure differential across the filter reaches a second predetermined level which is less than the first predetermined level. An end brace for the cooler housing includes an end cover which is designed to capture and retain the bypass valve in a recess formed at the end of the cooler housing remote from the support structure containing the supply and return flow passages.

Still other and more specific objects of the subject invention may be appreciated from the following Brief Description of the Drawings and the Best Mode for Carrying Out the Invention.

BEST MODE FOR CARRYING OUT THE INVENTION

Figure 1:
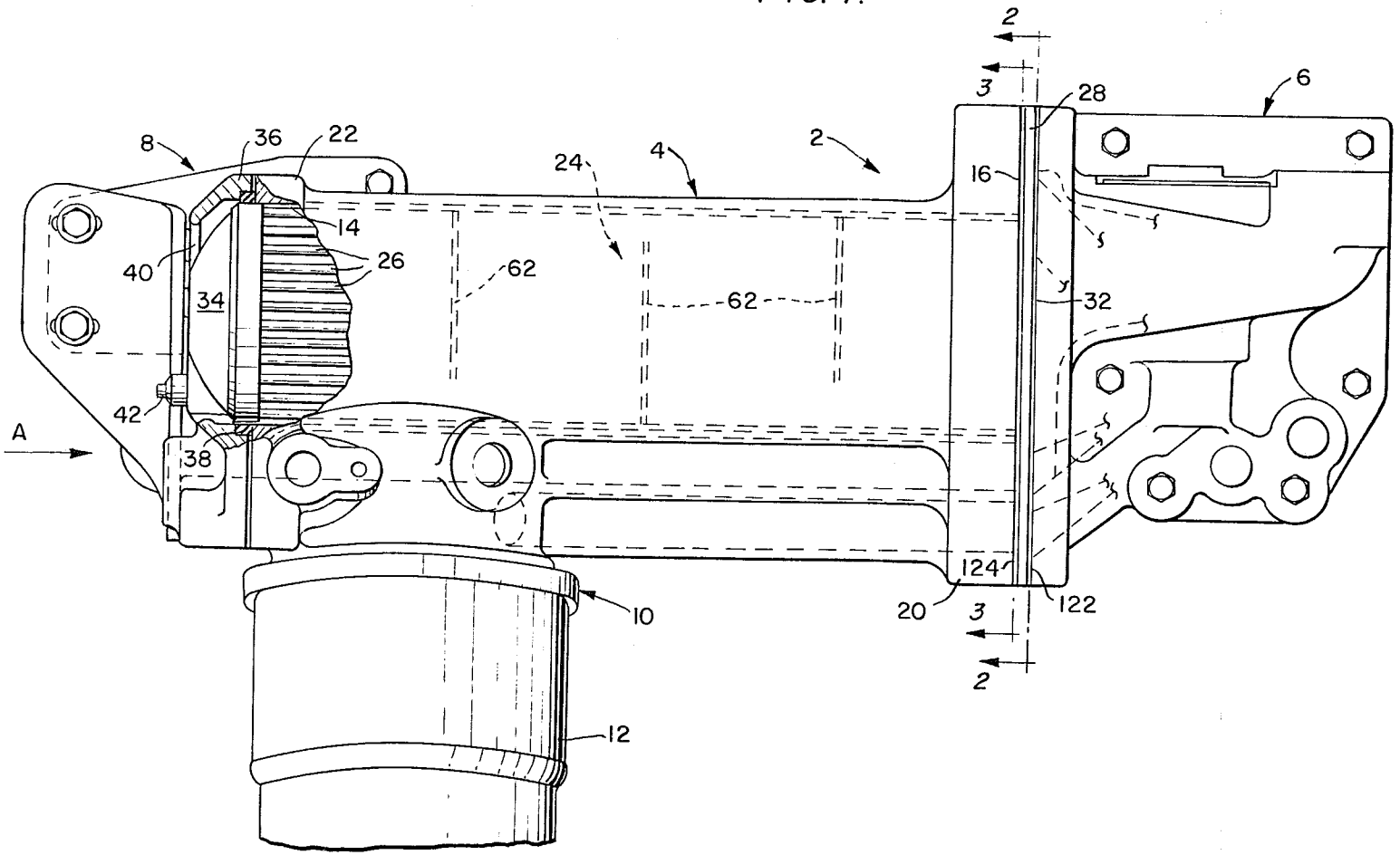
FIG. 1 is a partially broken away side elevational view of the oil cooler and filter assembly designed in accordance with the subject invention.

For a complete understanding of the subject invention, reference is initially made to the overall oil cooler and filter assembly design illustrated in FIG. 1. As is shown in this figure, the subject oil cooler and filter assembly 2 basically includes three major components; namely, a cooler housing 4, a support structure or means 6 for mounting the cooler housing 4 on the side of an engine (not illustrated) for providing fluid flow passages between the cooler housing and the recirculating coolant and lubrication oil circuits of the engine and brace means 8 for providing additional mounting support between the cooler housing 4 and the engine on which the cooler assembly and filter are mounted.

The cooler housing 4 specifically includes an oil filter connection means 10 for supporting a conventional type oil filter 12 in a manner to cause oil entering the cooler housing to pass through the filter prior to exiting the cooler housing 4 unless the oil filter 12 has become clogged or plugged in some manner. The cooler housing 4 is further characterized by an elongated internal cavity 14 extending the full length of the housing and opening at opposite ends into a planar end face 16 adjacent the support structure 6 and a planar end face 18 adjacent the brace means 8. As is apparent in FIG. 1, end face 16 is formed on a radially directed end flange 20 of the cooler housing 4 while end face 18 is formed on a somewhat smaller radially directed end flange 22 located on the opposite end of the cooler housing 4.

Positioned substantially within cooler housing 4 is a heat exchange means 24 for causing the lubrication oil and engine coolant to flow through the coolant housing 4 in fluidically isolated, heat exchange relationship. The heat exchange means 24 includes a plurality of elongated tubes 26 the end portions of which are illustrated in FIG. 1 adjacent the end flange 22. Heat exchange means 24 also includes tube mounting means 28 for mounting the elongated tubes 26 in spaced apart, parallel nested relationship within the elongated internal cavity 14. The tube mounting means 28 includes a flat plate-like member 30 sandwiched between end face 16 of the cooler housing 4 and an adjacent planar side 32 of the support structure 6. The heat exchange means 24 further includes a header 34 connected to the end of each elongated tube 26 remote from the flat plate-like member 30. Header 34 contains a transfer cavity (not illustrated) which communicates in sealed relationship with the interior of each of the elongated tubes 26. Header 34 is otherwise sealed from the exterior and is shaped to permit limited sliding movement within elongated internal cavity 14 of the cooler housing 4.

Brace means 8 includes a cover 36 for partially closing one end of internal cavity 14 and for retaining a fluid seal 38 in sliding engagement with the exterior surface of header 34. Seal 38 serves the purpose of accommodating differential thermal expansion between the length of cooler housing 4 and tubes 26 while maintaining internal cavity 14 in a sealed condition.

Cover 36 contains an aperture or opening 40 having a radial extent which is less than the radial extent of internal cavity 14. This arrangement tends to discourage dirt and other environmental contaminants from reaching fluid seal 38 and at the same time provides access to a cleaning plug 42 adjacent the lower portion of header 34 to thereby allow header 34 and the connected elongated tubes 26 to be flushed out during cleaning operation.

Figure 2:
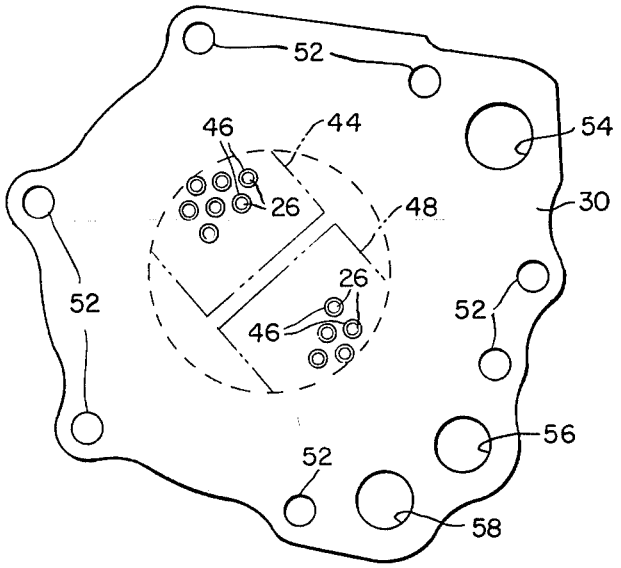
FIG. 2 is a cross-sectional view of the oil cooler and filter assembly shown in FIG. 1 taken along lines 2—2.

For a more complete understanding of the internal design of the subject cooler and filtering assembly, your attention is directed to FIG. 2 which discloses in greater detail the configuration of the flat plate-like member 30 referred to above. FIG. 2 clearly shows that the end of each elongated tube 26 is received in a corresponding aperture 46 in plate-like member 30. A first group of tube ends are identified by the numberal 44 while the ends of the remaining group are identified by the numeral 48. As will be described in greater detail hereinabelow, support structure 6 includes a coolant inlet passage arranged to supply engine coolant to the elongated tubes 26 forming group 48. After traveling through the group 48 tubes, the coolant is transferred in header 34 to the first group 44 of tubes for return to the support structure 6. A coolant return passage within support structure 6 receives the returning coolant ad discharges the same into the engine coolant system. A plurality of bores 52 are positioned and shaped to receive mounting bolts, not illustrated, used to mount the cooler housing 4 on the support structure 6. Plate-like member 30 also contains an oil supply aperture 54 through which oil flows from the support structure 6 into the cooler housing 4. Plate-like member 30 further includes an oil return aperture 56 through which oil flow from the cooler housing 4 is returned to the support structure 6. As will be described in greater detail below, support structure 6 contains an alternate flow passage through which engine lubrication oil flows into the cooler housing whenever the incoming lubrication oil is below a predetermined temperature. Flow of such cold lubrication oil is accommodated by a cold oil supply opening 58.

Figure 3:
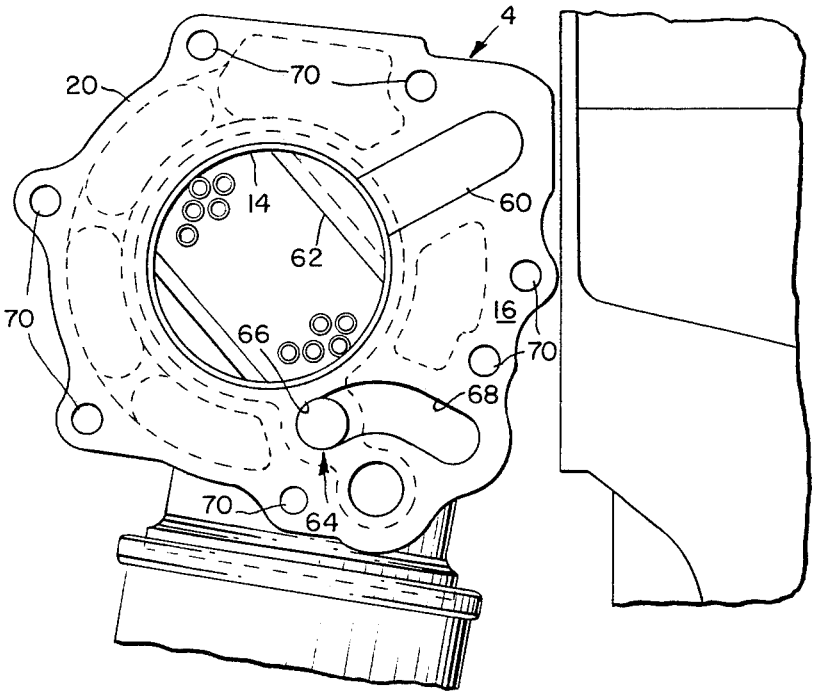
FIG. 3 is a cross-sectional view of the oil cooler and filter assembly of FIG. 3 taken along lines 3—3.

Reference is now made to FIG. 3 which discloses a cross sectional view of the end flange 20 of cooler housing 4 take along lines 3—3 of FIG. 1. This view clearly illustrates the circular cross sectional configuration of internal cavity 14. Oil entering the cooler housing 4 through oil supply aperture 54 will enter an oil supply transfer groove 60 formed in planar end face 16. Groove 60 is positioned to communicate with oil supply aperture 54 in plate-like member 30 and to communicate at the other end with the elongated internal cavity 14. Baffles 62 are intersected by tubes 26 and are spaced axially along the internal cavity 14 (best illustrated in FIG. 1) to form a serpentine oil flow path within the internal cavity 14. Obviously, oil moving through this pattern will come into heat exchange contact with the external surfaces of elongated tubes 26 through which the engine coolant is internally flowing.

As will be described in greater detail hereinbelow, cooler housing 4 also contains an oil return transfer flow path 64 communicating at one end with the elongated internal cavity 14 adjacent flange 22 and at the other end with the oil return aperture 56 of plate-like member 30. The portion of the oil return transfer path 64 shown in FIG. 3 includes an oil return channel 66 extending in parallel relationship with the elongated internal cavity 14 along substantially the entire length of the cooler housing 4. Flow path 64 further includes a transfer groove 68 formed in end face 16 to communicate at one end with oil return channel 66 and at the other end with oil return aperture 56 in plate-like member 30. Transfer groove 68 is required because return channel 66 is ot aligned with return aperture 56 as is clearly evidenced by comparison of FIGS. 2 and 3. The same figures show that bolt receiving apertures 52 are designed to be aligned with corresponding bolt receiving apertures 70 in flange 20 of the cooler housing 4.

FIG. 3 also shows that the cooler housing 4 contains a cold oil supply channel 69 which extends along substantially the entire length of the oil cooler housing in parallel relationship with return channel 66. The cold oil supply channel 69 communicates at one end with the cold oil supply opening 58 contained in plate-like member 30 and at the other end with the oil filter connection means 10 in a manner to cause oil flowing through the cold oil supply channel to pass through the oil filter before returning to the support structure 6 through the oil return channel 66.

Figure 4:
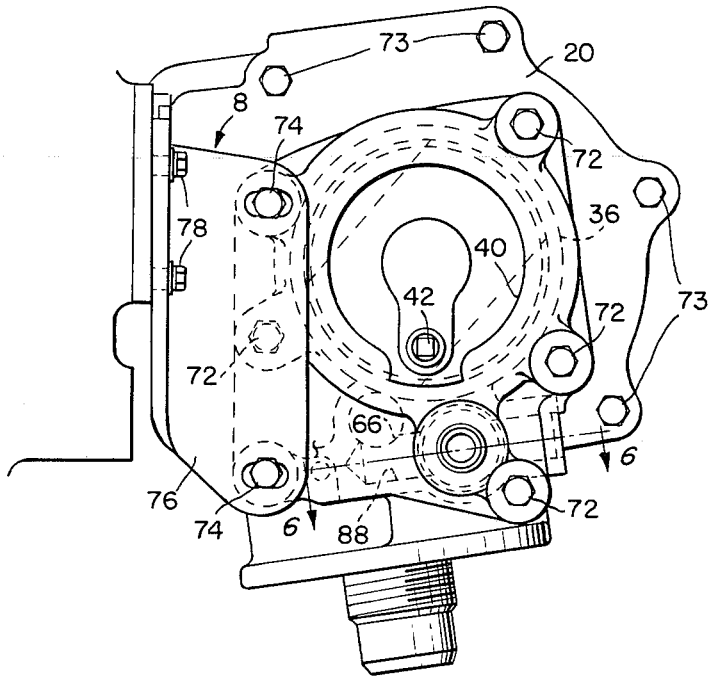
FIG. 4 is an end elevational view of the oil cooler and filter assembly shown in FIG. 1 taken in the direction of arrow A.
Figure 5:
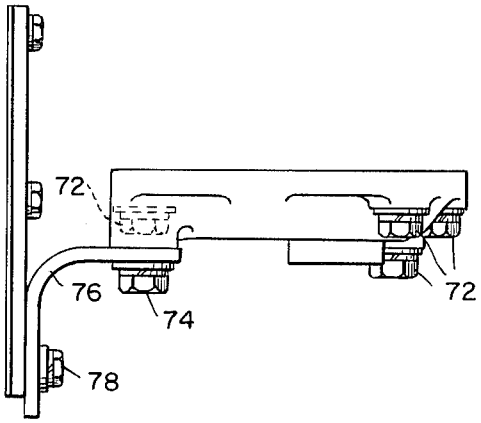
FIG. 5 is a top elevational view of the end brace and cover employed to support the oil cooler housing illustrated in FIGS. 1 and 4.

Reference is now made to FIG. 4 in which flange 20 of the cooler housing 4 is illustrated as being bolted to the support structure 6 (not illustrated) by threaded bolts 73. FIG. 4 also discloses brace means 8 including cover 36 in greater detail. In particular, cover 36 contains aperture 40 through which access to cleaning plug 42 may be had. Cover 36 is also adapted to close off oil return channel 66 (illustrated in dashed lines). In addition to threaded mounting bolts 72 which pass through corresponding apertures in cover 36 for threaded engagement with corresponding bores in cooler housing 4, two additional mounting bolts 74 are arranged to pass through corresponding holes in one leg of an L-shaped bracket 76. A second leg of bracket 76 is arranged to be mounted on the engine by means of threaded bolts 78. The configuration of brace means 8 (including cover 36 and L-shaped bracket 76) is further illustrated in FIG. 5 which is a top elevational view of these elements.

Figure 6:
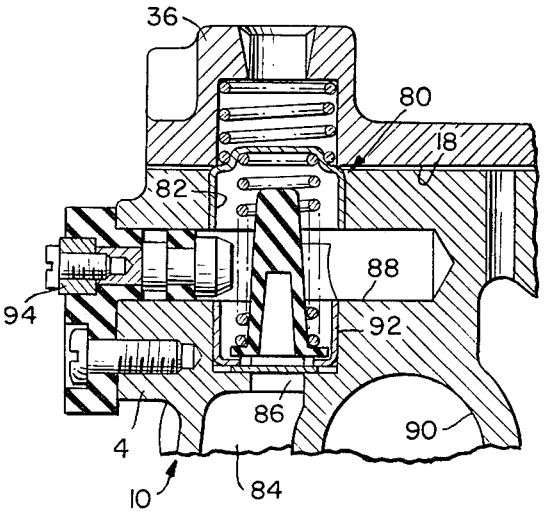
FIG. 6 is a cross sectional view of an oil pressure responsive valve and warning device used in the oil cooler and filter assembly shown in FIG. 4 taken along lines 6—6.

Referring now to FIG. 6, a cross sectional view of the cover 36 and cooler housing 4 taken along lines 6—6 of FIG. 4 is illustrated. This portion of the cooler housing contains an oil pressure responsive valve means 80 received in a valve recess 82 opening into end face 18 of cooler housing 4. Cover 36 provides the useful function of capturing and retaining the oil pressure responsive valve means 80 when placed within recess 82. One end of recess 82 communicates with the circular inlet channel 84 formed by the oil filter connection means 10 through a return opening 86. A cross bore 88 intersects with recess 82 and also with oil return channel 66 as best illustrated in FIG. 4. Oil return channel 66 also communicates with the central channel 90 of the oil filter connection means 10. Central channel 90 receives the filtered oil from the oil filter. By this arrangement, valve means 80 is positioned to respond to the differential input pressure existant between inlet channel 84 and central channel 90. In particular, valve means 80 includes a spring biased piston assembly 92 which normally maintains inlet opening 86 in a closed condition but which yields to a predetermined pressure differential to first create an electrical warning signal through electrical terminal 94 and subsequently opens to create a flow path which bypasses the oil filter and allows oil entering circular inlet channel 84 to pass through recess 82 and cross bore 88 and into return channel 66. The operation of valve means 80 is described in much greater detail in commonly assigned co-pending applications, Ser. No. 214,673, filed Dec. 9, 1980, entitled: Early Warning Bypass Valve Assembly and continuation-in-part application, Ser. No. 318,101, filed Nov. 5, 1981, entitled: Bypass Valve and Alarm Assembly.

Figure 7:
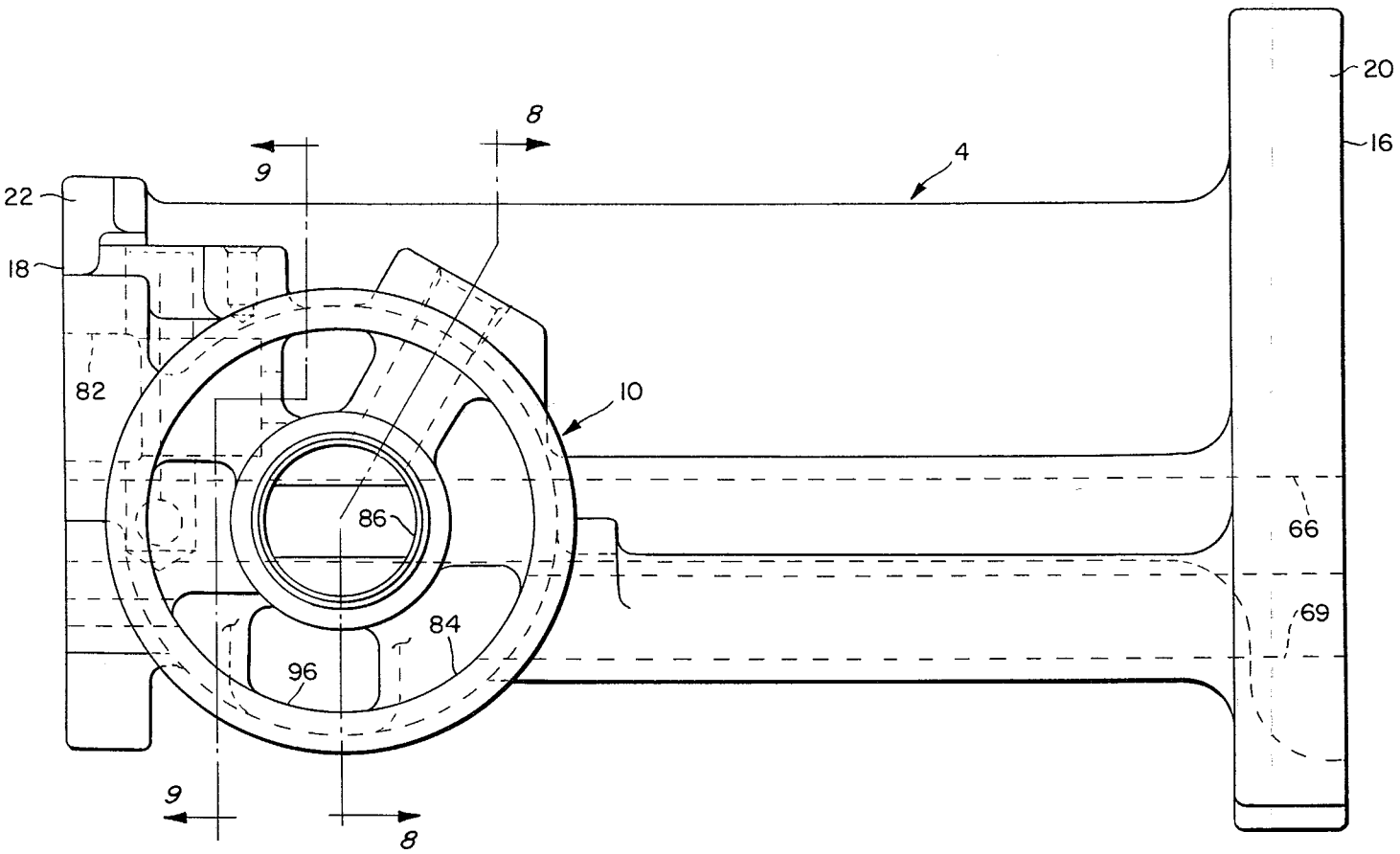
FIG. 7 is a bottom elevational view of the cooler housing designed in accordance with the subject invention.

FIG. 7 illustrates a bottom elevational view of the cooler housing 4 clearly illustrating the configuration of end flanges 20 and 22 as well as the position of oil return channel 66 and cold oil supply channel 69. In particular, cold oil supply channel 69 intersects circular inlet channel 84 of the oil filter connection means 10. Thus when cold oil is directed through supply channel 69, such oil entirely bypasses the heat exchanger structure within the internal cavity 14 of the cooler housing 4 and enters the oil filter directly through circular inlet channel 84. All oil returning from the filter passes through return opening 86 which communicates directly with oil return channel 66 for return to the support structure 6. The position of valve recess 82 is also illustrated in FIG. 7.

Figure 8:
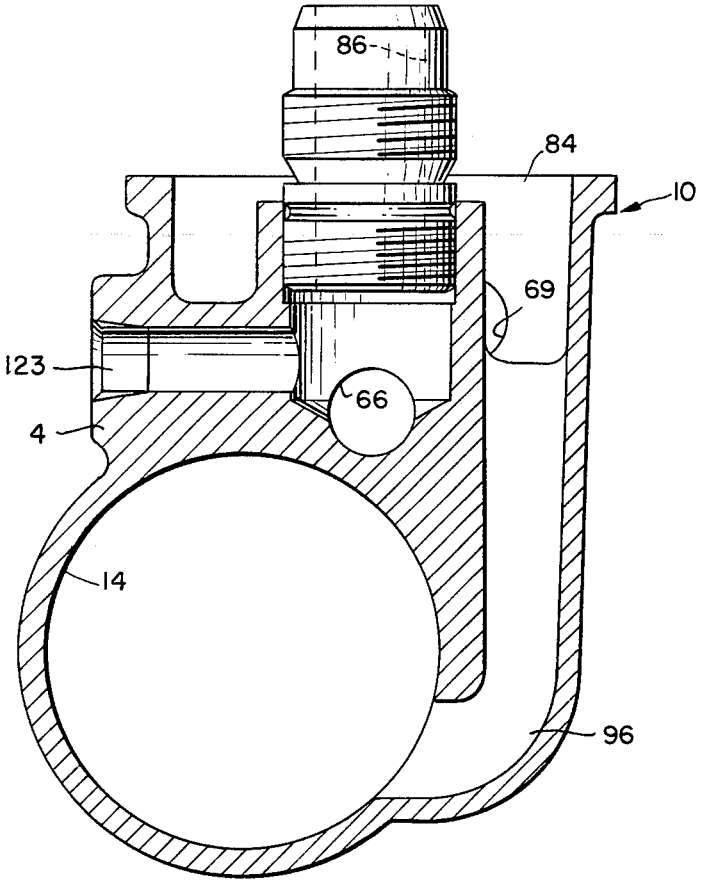
FIG. 8 is a cross sectional view of the cooler housing illustrated in FIG. 7 taken along lines 8—8.

Referring now to FIG. 8, which is a cross sectional view of the oil cooler housing 4 taken along lines 8—8 of FIG. 7, the remaining portions of the oil return transfer flow path 64 are illustrated. In particular, the oil return transfer flow path 64 includes a connecting passage 96 communicating at one end with the elongated internal cavity 14 at a point adjacent flange 22 of the cooler housing and communicating at the other end with circular inlet channel 84 of the oil filter connecting means 10. Thus, in all cases, except upon operation of the oil pressure responsive valve means 80, all oil flowing through internal cavity 14 will pass through the oil filter connected to connection means 10 and return to the cooler housing through return opening 86.

Figure 9:
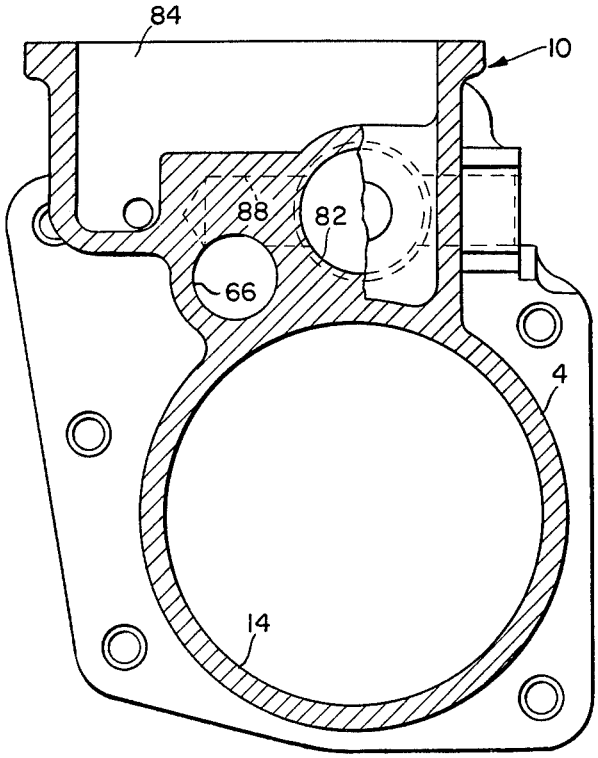
FIG. 9 is a cross sectional view of the cooler housing illustrated in FIG. 7 taken along lines 9—9.
Figure 10:
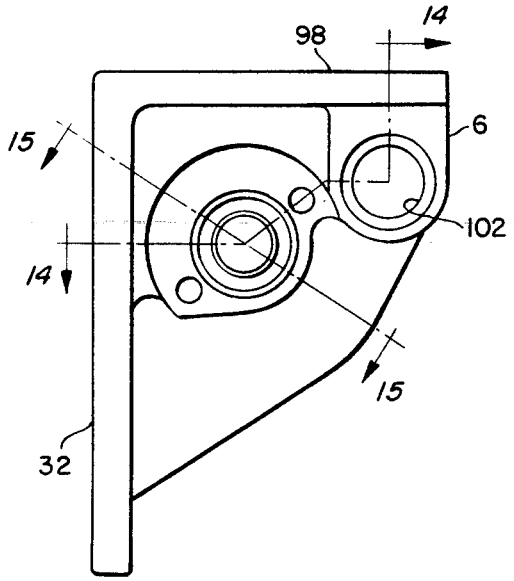
FIG. 10 is a top elevational view of the mounting structure for mounting the cooler housing on an internal combustion engine designed in accordance with the subject invention.

FIG. 9, a cross sectional view taken along lines 9—9 of FIG. 7, further illustrates the relationship of valve recess 82, cross bore 88 and oil return channel 66 as were discussed above.

Reference is now made to FIGS. 10-20 which disclose various views of the support structure 6 designed in accordance with the subject invention. In particular, FIG. 10 discloses a top elevational view of the support structure 6 wherein it is shown that the support structure 6 includes a generally planar first side 98 adapted to engage the side of an internal combustion engine having an oil support port, an oil return port and a coolant supply port formed in closely adjacent relationship. These engine block ports are not illustrated in FIG. 10. Support structure 6 further includes a generally planar structure 6 further includes a generally planar second side 32 arranged perpendicular to first side 98. Second side 32 is adapted to cooperate with flange 20 of the cooler housing 4 in a manner to rigidly fix plate-like member 30 of the heat exchange means 24. Aperture 102, formed on the top side of support structure 6, is a discharge opening for engine coolant and is adapted to be connected to an external conduit for directing the engine coolant to another portion of the engine.

Figure 11:
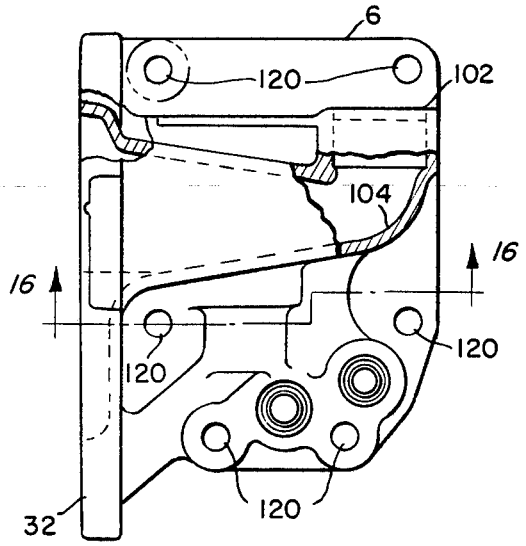
FIG. 11 is a partially broken away side elevational view of the mounting structure illustrated in FIG. 10.
Figure 12:
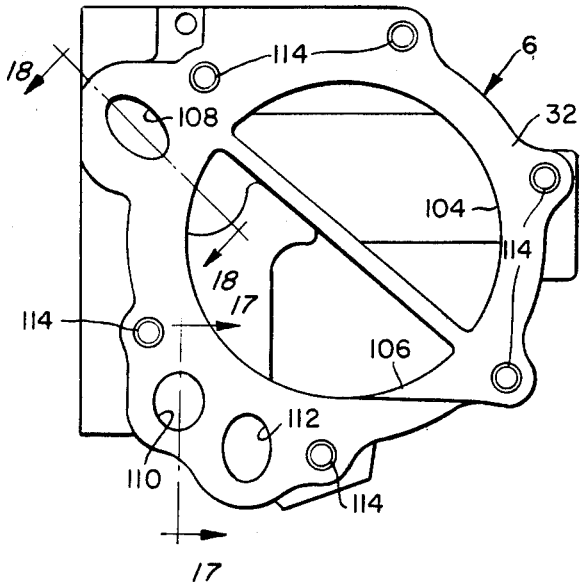
FIG. 12 is an elevational view of the side of the mounting structure which engages the cooler housing.

A small section of the side elevational view of support structure 6 illustrated in FIG. 11 has been broken away to shown, in cross section, a portion of the coolant return passage 104 extending from second side 32 to coolant discharge port 102. The portion of coolant return passage 104 opening into second side 32 is aligned generally with the first group 44 of elongated tubes 26 illustrated in FIG. 2. This portion of coolant return passage 104 is best illustrated in FIG. 12 which is an elevational view of second side 32. Coolant is supplied to the remaining group 48 of elongated tubes 26 (as illustrated in FIG. 2) by means of a coolant supply passage 106 which opens into second side 32 as illustrated in FIG. 12. Similarly, an oil supply passage 108 and an oil return passage 110 also open into second side 32 as illustrated in in FIG. 12. In certain circumstances, oil entering the oil supply passage 108 will be diverted through a cold oil supply branch 112 which opens into second side 32 as also illustrated in FIG. 12. A plurality of threaded bores 114 are arranged to receive threaded bolts 73 as illustrated in FIG. 4.

Figure 13:
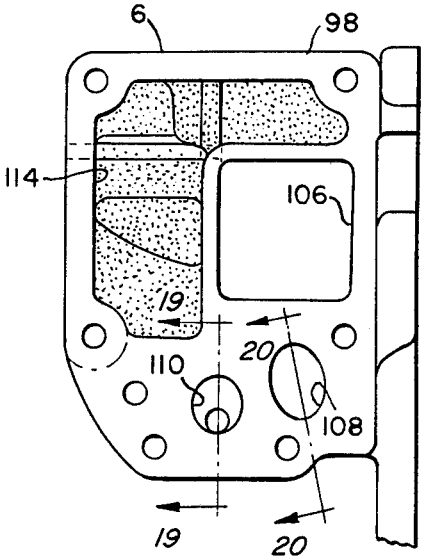
FIG. 13 is the side of the mounting structure of FIGS. 10-12 which engages the engine block.
Figure 14:
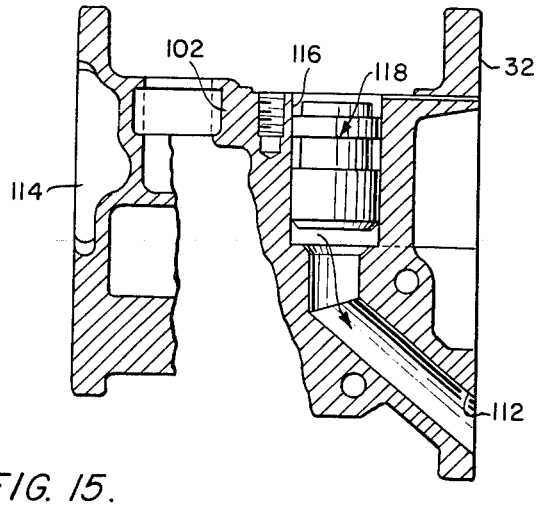
FIG. 14 is a partially broken away cross sectional view of the mounting structure illustrated in FIG. 10 taken along lines 14—14.
Figure 15:
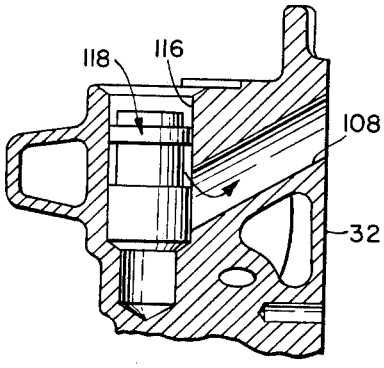
FIG. 15 is a partially broken away cross sectional view of the mounting structure of FIG. 10 taken along lines 15—15.

Reference is now made to FIG. 13 which discloses an elevational view of the generally planar first side 98 of support structure 6. In particular, coolant supply passage 106 opens into the first side 98 as illustrated in FIG. 13. Similarly, oil supply passage 108 and oil return passage 110 open into side 98 as shown in FIG. 13. First side 98 contains a recess portion 114 which is closed and is formed merely to lighten the total weight of the support structure 6. The coolant supply port and the engine oil supply and return ports referred to above are formed on the engine in a pattern which causes these ports to align with passages 106, 108 and 110, respectively, in side 98. A gasket or other sealing material may be applied between the surface 98 and the engine block to assure the integrity of the seal between the engine and the support structure 6 and between the various flow paths into and out of the support structure 6. Similarly a pair of gaskets or other sealing material 122 and 124 (FIG. 1) may be interposed between the plate-like member 30 and side 32 of support structure 6 and also between the plate-like member 30 and end face 16 of the cooler housing 4 to seal around the oil supply aperture 54, the oil return aperture 56, the cold oil supply opening 58, the first group 44 of tube ends and the second group 48 of remaining tube ends, whereby oil and coolant may pass between the support structure 6 and cooler housing 4 without leakage from one passage to another and without leakage to the exterior of the cooler and filter assembly. Reference is now made to FIGS. 14 and 15 which disclose cross sectional views of the support structre 6 taken along lines 14—14 and 15—15, respectively, of FIG. 10. Both FIGS. 14 and 15 disclose an open top recess 116 adapted to receive a thermostatically controlled valve means 118 for causing the oil entering supply passage 108 to be diverted into cold oil supply branch 112 whenever the incoming oil temperature is below a predetermined level. The exact structure and configuration of thermostatically controlled valve means 118 is not disclosed since any well known thermostatically operated valve structure may be used.

Figure 16:
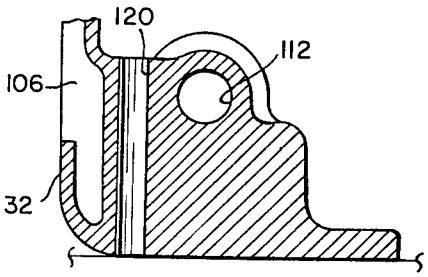
FIG. 16 is a partially broken away cross sectional view of the mounting structure illustrated in FIG. 11 taken along lines 16—16.

FIG. 16 discloses a cross sectional view of the support structure 6 taken along lines 16—16 of FIG. 11 and particularly shows a bore 120 for receiving a mounting bolt for holding the support structure 6 in contact with the block of an internal combustion engine. Similar bores are illustrated in FIG. 11.

Figure 17:
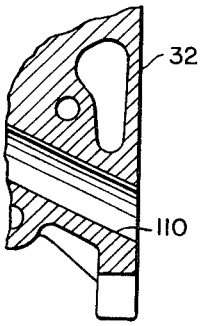
FIG. 17 is a partially broken away cross sectional view of the mounting structure illustrated in FIG. 12 taken along lines 17—17.
Figure 19:
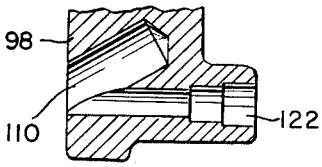
FIG. 19 is a partially broken away cross sectional view of the mounting structure illustrated in FIG. 13 taken along lines 19—19.

FIG. 17 is a cross sectional view of the section of the oil return passage 110 which opens into second side 32. The portion of oil return passage 110 shown in FIG. 17 intersects with another portion illustrated in FIG. 19 which is a cross sectional view of the oil return passage 110 as it intersects with the first side 98 of the support structure 6. An additional passage 122 is shown in FIG. 19 for communication with a conduit designed to receive oil from an engine turbocharger. Oil may be supplied to a turbocharger through passage 123 as illustrated in FIG. 8.

Figure 18:
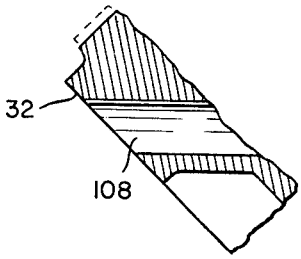
FIG. 18 is a partially broken away cross sectional view of the mounting structure illustrated in FIG. 12 taken along lines 18—18.
Figure 20:
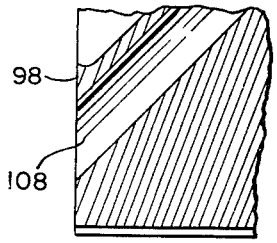
FIG. 20 is a partially broken away cross sectional view of the mounting structure illustrated in FIG. 13 taken along lines 20—20.

FIG. 18 is a cross-sectional view of the portion of oil supply passage 108 that intersects with second side 32 and FIG. 20 is a cross sectional view of the portion of oil supply passage 108 which intersects with first side 98. Although not specifically illustrated, a portion of oil supply passage 108 shown in FIG. 20 intersects with top opening recess 116 as illustrated in FIGS. 14 and 15 to supply the incoming oil which flows either into the portion of oil supply passage 108 illustrated in FIG. 15 or into cold oil supply branch 112 illustrated in FIG. 14.

INDUSTRIAL APPLICABILITY

The subject cooler and filter assembly is particularly suitable for use on internal combustion engines having recirculating oil and coolant circuits. The thermostatic valve can be designed to promote more efficient engine operation by causing the lubrication oil temperature to be more nearly optimal throughout a greater range of engine operating conditions than is possible without such thermostatic valve control. The compact size, yet highly rugged and reliable, design makes the subject cooler and filter assembly ideal for use on vehicle engines such as heavy duty ignition compression engines used on trucks and construction equipment. Another advantage is that only a pair of relatively simple gaskets are needed to form a substantial number of critical seals in the disclosed assembly design.

I claim:

1. An oil cooler assembly for use on an internal combustion engine having a recirculating lubrication oil circuit and a recirculating engine coolant circuit, comprising (a) a cooler housing having a planar end surface and an elongated internal cavity one end of which opens into said planar end surface;

(b) support means for mounting said cooler housing on the engine and for providing isolated fluid flow passages between the cooler housing and the recirculating lubrication oil circuit and the recirculating engine coolant circuit;

(c) heat exchange means for causing the lubrication oil and engine coolant to flow through said cooler housing in fluidically isolated, heat exchange relationship, said heat exchange means including (1) a plurality of elongated tubes, and (2) tube mounting means for mounting said tubes in spaced apart, parallel nested relationship within said housing cavity, said tube mounting means including a flat plate-like member sandwiched between said cooler housing and said support means, said flat plate-like member containing means for supporting the elongated tubes at the ends thereof and at least one oil inlet aperture through which oil flows from said support means to said cooler housing and at least one oil return aperture through which oil flows from said cooler housing into said support means.

2. An oil cooler assembly as defined by claim 1 for use with an engine having an oil supply port and an oil return port adjacent the oil supply port on the exterior of the engine, wherein said support means includes a generally planar first side for sealingly engaging the engine around the oil supply and coolant supply ports, and further wherein said support means contains an oil supply passage extending from the oil supply port to said oil inlet aperture and an oil return passage extending from said oil return aperture to the oil return port.

3. An oil cooler assembly as defined by claim 2 for use with an engine having a coolant supply port adjacent the oil supply and return ports, wherein said plate-like member supports the elongated tubes by receiving the end of each tube in a corresponding tube aperture formed in said flat, plate-like member and further wherein said support means contains a coolant supply passage extending from the coolant supply port to a first group of said elongated tubes supported by said flat plate-like member to allow coolant to flow from the coolant supply port through said coolant supply passage into said first group of said elongated tubes and further wherein said heat exchange means includes a header connected to the ends of all of said elongated tubes opposite from said flat plate-like member, said header containing a transfer cavity communicating with the interior of each of said elongated tubes whereby coolant flowing through said first group of elongated tubes is transferred in said header for return to said support means through the remaining elongated tubes which form a second group of elongated tubes.

4. An oil cooler assembly as defined by claim 3, wherein the exterior of said header is slidably sealed to the interior surface of said elongated internal cavity in a manner to permit relative axial movement of said header with respect to said cooler housing in response to thermally induced changes in the length of said elongated tubes.

5. An oil cooler assembly as defined by claim 4, wherein said cooler housing includes an oil supply transfer flowpath for communicating at one end with said oil inlet aperture and at the other end with said elongated internal cavity adjacent said flat, plate-like member, and an oil return transfer flowpath communicating at one end with said elongated internal cavity at a point remote from said flat plate-like member and at the other end with said oil return aperture, and further wherein said heat exchange means includes a plurality of baffles intersected by said elongated tubes and spaced axially along said elongated internal cavity, said baffles being shaped to form a serpentine flow path within said elongated internal cavity and exterior to said elongated tubes for oil moving from said oil supply transfer flowpath to said oil return transfer flowpath.

6. An oil cooler assembly as defined by claim 5, wherein said oil return transfer flowpath includes a return channel extending in parallel relationship with said elongated internal cavity along substantially the entire length of said cooler housing.

7. An oil cooler assembly as defined by claim 6, wherein said cooler housing includes an oil filter connection means for supporting an oil filter on said cooler housing in a manner to cause oil entering said oil return transfer flowpath from said elongated internal cavity to pass through an oil filter before returning to said support means through said return channel.

8. An oil cooler assembly as defined by claim 7, wherein said flat plate-like member contains a cold oil supply opening and said supply passage within said support means includes a cold oil supply branch communicating at one end with said cold oil supply opening and still further wherein said cooler housing contains a cold oil supply channel extending along substantially the entire length of said oil cooler housing in parallel relationship with said return channel, said cold oil supply channel communicating at one end with said cold oil supply opening and at the other end with said oil filter connection means in a manner to cause oil flowing through said cold oil supply channel to pass through the oil filter and return to said support means through said return channel.

9. An oil cooler assembly as defined by claim 8, wherein said support means contains a thermostatically controlled valve means for causing oil entering said oil supply passage to flow into said cold oil supply channel through said cold oil supply branch and said cold oil supply opening whenever the temperature of the oil is below a predetermined level.

10. An oil cooler assembly as defined by claim 9, wherein said cooler housing includes an oil pressure responsive valve means for responding to the differential in oil pressure entering and leaving an oil filter mounted on said oil filter connection means to cause oil to bypass the filter whenever the oil pressure differential is above a predetermined level.

11. An oil cooler assembly as defined by claim 10, wherein said oil pressure responsive valve means includes a warning signal generating means for generating a warning signal whenever the oil pressure differential across the oil filter reaches a second predetermined level which is less than the first predetermined level.

12. An oil cooler assembly as defined by claim 3, wherein said support means includes a generally planar second side perpendicular to said first side, and wherein the ends of said coolant supply, oil supply and oil return passages reside within said first and second sides respectively.

13. An oil cooler assembly as defined by claim 12, wherein said support means contains a coolant discharge port and a coolant return passage extending between the end of said second group of elongated tubes mounted in said flat plate-like member and said coolant discharge port.

14. An oil cooler assembly as defined in claim 6, wherein said return channel is offset axially from said oil return aperture contained in said flat plate-like member and wherein said cooler housing contains a transfer groove on the end face of said cooler housing which is positioned adjacent said flat plate-like member, said transfer groove communicating at one end with said return channel and at the other end with said oil return aperture.

15. An oil cooler assembly as defined by claim 8, further including gasket sealing means interposed between said flat plate-like member and said support means and between said flat plate-like member and said cooler housing to fluidically seal said oil supply aperture, said oil transfer aperture, said oil return aperture, said cold oil return opening and the ends of said first and second groups of elongated tubes from each other.

16. An oil cooler assembly as defined by claim 4, wherein said support means causes said cooler housing to extend along the side wall of the engine and wherein said cooler housing has an end face remote from said support means into which said elongated internal cavity opens, and further including brace means for providing additional mounting support between said cooler housing and the engine on which it is mounted, said brace means including a cover mounted on an end face of said cooler housing, and an L-shaped bracket having one leg connected to said cover and one leg adapted to be connected to the engine.

17. An oil cooler assembly as defined by claim 16, wherein said cover contains an opening axially aligned with said elongated internal cavity and having a radial extent which is less than the radial extent of said elongated internal cavity.

18. An oil cooler assembly as defined by claim 16, wherein said cooler housing contains a valve recess for receiving said oil pressure responsive means opening into said end face and wherein said cover extends over said recess to capture and retain said oil pressure responsive means within said recess.

19. An oil cooler assembly for use on an internal combustion engine having a recirculating lubrication oil circuit and a recirculating engine coolant circuit, comprising (a) a cooler housing having a planar end surface and an elongated internal cavity one end of which opens into said planar end surface said cooler housing containing (1) an oil supply transfer flowpath for supplying oil to said internal cavity, (2) an oil return transfer flowpath for receiving oil from said internal cavity and (3) an oil filter connection means for supporting an oil filter on said cooler housing in a manner to cause oil entering said oil return transfer flowpath from said elongated internal cavity to pass through an oil filter, (b) support means for mounting said cooler housing on the engine and for providing isolated fluid flow passages between the cooler housing and the recirculating lubrication oil circuit and the recirculating engine coolant circuit;

(c) heat exchange means for causing the lubrication oil and engine coolant to flow through said internal cavity in fluidically isolated, heat exchange relationship, said heat exchange means including (1) a plurality of elongated tubes, and (2) tube mounting means for mounting said tubes in spaced apart, parallel nested relationship within said housing cavity, said tube mounting means including a flat plate-like member sandwiched between said cooler housing and said support means at the end of said cooler housing remote from said oil filter connection means.

20. An oil cooler assembly as defined by claim 19 wherein said cooler housing includes an oil pressure responsive valve means for responding to the differential in oil pressure entering and leaving an oil filter mounted on said oil filter connection means to cause oil to bypass the filter whenever the oil pressure differential is above a predetermined level and wherein said cooler housing further contains a valve recess for receiving said oil pressure responsive means opening into said end face.

21. An oil cooler assembly as defined by claim 20, wherein said support means causes said cooler housing to extend along the side wall of the engine and wherein said cooler housing has an end face remote from said support means into which said elongated internal cavity opens, and further including brace means for providing additional mounting support between said cooler housing and the engine on which it is mounted, said brace means including a cover mounted on an end face of said cooler housing, and an L-shaped bracket having one leg connected to said cover and one leg adapted to be connected to the engine, wherein said cover extends over said recess to capture and retain said oil pressure responsive means within said recess.

* * * * *